US012595426B2

(12) United States Patent
Fischer et al.

(10) Patent No.: US 12,595,426 B2
(45) Date of Patent: Apr. 7, 2026

(54) PROCESS FOR REMOVING CONTAMINANTS FROM CRUDE OIL

(71) Applicant: SHELL OIL COMPANY, Houston, TX (US)

(72) Inventors: Kai Jürgen Fischer, Amsterdam (NL); Sybe Sipma, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 1111 days.

(21) Appl. No.: 17/621,276

(22) PCT Filed: Jul. 24, 2020

(86) PCT No.: PCT/US2020/043426
§ 371 (c)(1),
(2) Date: Dec. 21, 2021

(87) PCT Pub. No.: WO2021/016528
PCT Pub. Date: Jan. 28, 2021

(65) Prior Publication Data

US 2022/0356406 A1 Nov. 10, 2022

(30) Foreign Application Priority Data

Jul. 24, 2019 (EP) ..... 19188121

(51) Int. Cl.
*C10G 21/27* (2006.01)
*C10G 21/28* (2006.01)
*C10G 53/06* (2006.01)

(52) U.S. Cl.
CPC ..... *C10G 21/27* (2013.01); *C10G 21/28* (2013.01); *C10G 53/06* (2013.01)

(58) Field of Classification Search
CPC ..... C10G 21/27; C10G 21/28; C10G 21/16; C10G 21/20; C10G 53/06
See application file for complete search history.

(56) References Cited

U.S. PATENT DOCUMENTS 2,600,184 A 6/1952 Arnold et al.
3,864,245 A 2/1975 Van Tassell
(Continued)

FOREIGN PATENT DOCUMENTS

CA 2214305 A1 2/1999
CN 106833719 A 6/2017
(Continued)

OTHER PUBLICATIONS

English machine translation of CN 106833719 (Year: 2017).*
(Continued)

*Primary Examiner* — Renee Robinson
(74) *Attorney, Agent, or Firm* — SHELL USA, INC.

(57) ABSTRACT

The present invention provides a process for the removal of contaminants from contaminated crude oil in a vessel. An organic solvent stream is provided to the vessel containing crude oil. After mixing, an organic solvent bottom phase is allowed to form. The bottom phase comprises at least a portion of the organic solvent stream and at least a portion of the contaminants. The bottom phase is removed from the vessel, while the remaining crude oil is retained in the vessel. An aqueous stream is provided to the vessel and mixed with the remaining crude oil, allowing an aqueous bottom phase to form. The aqueous bottom phase is removed from the vessel, while the remaining crude oil is retained in the vessel.

11 Claims, 2 Drawing Sheets

(56) References Cited

U.S. PATENT DOCUMENTS

| | | | |
|---|---|---|---|
| 4,048,062 | A | 9/1977 | Asselin |
| 4,764,256 | A | 8/1988 | Way |
| 4,992,210 | A | 2/1991 | Naeger et al. |
| 5,041,206 | A | 8/1991 | Sequeira, Jr. |
| 5,114,566 | A | 5/1992 | Naeger et al. |
| 5,731,483 | A | 3/1998 | Stabel et al. |
| 6,565,742 | B1 | 5/2003 | Gentry et al. |
| 8,709,233 | B2 | 4/2014 | McCoy et al. |
| 8,961,780 | B1 | 2/2015 | Yusuf et al. |
| 9,440,947 | B2 | 9/2016 | Lee et al. |
| 10,767,122 | B2 | 9/2020 | Oprins et al. |
| 10,851,309 | B2 | 12/2020 | Ramamurthy et al. |
| 10,927,315 | B2 | 2/2021 | Ramamurthy et al. |
| 2008/0194900 | A1 | 8/2008 | Bhirud |
| 2009/0107890 | A1 | 4/2009 | Hamad et al. |
| 2010/0300932 | A1 | 12/2010 | Debuisschert et al. |
| 2011/0155645 | A1 | 6/2011 | Serban et al. |
| 2013/0220884 | A1 | 8/2013 | Bourane et al. |
| 2016/0369184 | A1 | 12/2016 | Ward et al. |
| 2016/0369190 | A1 | 12/2016 | Ward et al. |
| 2018/0355256 | A1 | 12/2018 | Dooley |
| 2019/0177626 | A1 | 6/2019 | Ramamurthy et al. |
| 2020/0080009 | A1 | 3/2020 | Derks |

FOREIGN PATENT DOCUMENTS

| | | | |
|---|---|---|---|
| EP | 0697455 | A2 | 2/1996 |
| GB | 1248814 | A | 10/1971 |
| GB | 1554767 | A | 10/1979 |
| GB | 2040306 | A | 8/1980 |
| JP | S466527 | Y1 | 3/1971 |
| JP | S62119294 | A | 5/1987 |
| JP | 2006512438 | A | 4/2006 |
| WO | 0046322 | A1 | 8/2000 |
| WO | 2010070029 | A1 | 6/2010 |

OTHER PUBLICATIONS

Office Action Received for European Application No. 20751833.3, Mailed on Aug. 24, 2023, 5 Pages.

Office Action Received for Japanese Application No. 2021-561687, Mailed on Apr. 2, 2024, 17 Pages(08 Pages of English Translation and 09 Pages of Official Copy).

International Search Report and Written Opinion received for PCT Patent Application No. PCT/US2020/043426, mailed on Aug. 28, 2020, 11 pages.

International Search Report and Written Opinion received for PCT Patent Application No. PCT/EP2020/060410, mailed on May 4, 2020, 09 pages.

Office Action Received for Chinese Application No. 201780075338.5, mailed on Apr. 26, 2021, 16 pages (8 pages of English Translation and 8 pages of Official Copy).

International Search Report and Written Opinion received for PCT Patent Application No. PCT/EP2017/081817 mailed on Feb. 19, 2018, 09 pages.

Muhammad et al. "Catalytic Pyrolysis of Waste Plastic From Electrical and Electronic Equipment" Journal of Analytical and Applied Pyrolysis, vol. 113, 2015, pp. 332-339.

Banerjee, "Thermal Processing of Hydrocarbons—Petroleum to Petrochemicals", 2019, 4.4.2 Furnace Design, 18 pages.

Li et al. "Analysis and Comparison of Nitrogen Compounds in Different Liquid Hydrocarbon Streams Derived from Petroleum and Coal" Energy& Fuels, vol. 24, Issue No. 10, Oct. 4, 2010, pp. 5539-5547.

Kianglin et al. "China Refining Technology", Jul. 31, 2001, pp. 327-328.

Office Action Received for Eurasian Application No. 202290394, Mailed on Feb. 7, 2023, 4 Pages (2 Pages of English Translation and 2 Pages of Official Copy).

* cited by examiner

PROCESS FOR REMOVING CONTAMINANTS FROM CRUDE OIL

CROSS REFERENCE TO RELATED APPLICATIONS

This is a National stage application of International application No. PCT/US2020/043426, filed Jul. 24, 2020, which claims priority of EP application Ser. No. 19/188,121.8, filed 24 Jul. 2019 which is incorporated herein by reference in its entirety.

FIELD OF THE INVENTION

The present invention is directed to a process for removing contaminants from a hydrocarbon stream, such as crude oil.

BACKGROUND OF THE INVENTION

Crude oils are a mixture of many substances that are often difficult to separate. As well as desirable hydrocarbons, crude oils contain aromatics and polyaromatic materials, such as asphaltenes, which need removing before production of the desired products. Crude oil may also contain many contaminants, including naturally occurring contaminants, such as rock fragments and salt water, as well as dissolved chemical species such as heteroatom-containing hydrocarbons. Further, non-naturally occurring materials may contaminate the crude oil during production and handling.

Once crude oil reaches a refinery, contaminants must be dealt with in order to prevent problems resulting from fouling and corrosion of process equipment, emissions or disposals exceeding permitted levels, or poisoning of downstream units, for example through catalyst deactivation. Certain contaminants may be removed using membranes or filters (see, for example, WO2010070029). Other contaminants are more difficult to remove before refining.

Organic chlorides are sometimes used as a solvent in oil production sites and there have been reports of sabotage, wherein organic chlorides have been added to crude streams allegedly to deliberately disrupt supply chains. Organic chlorides, such as tetrachloromethane, trichloromethane (chloroform) and dichloromethane, are particularly problematic in refineries as their presence during the refining process results in the production of hydrochloric acid. Hydrochloric acid attacks metal resulting in corrosion of equipment with the associated risk of leaks and other safety incidents. Further, there are strict legislative regulations regarding organic chloride contamination of crude oil for fuel production due to their impact of enhancing dioxin emissions in combustion off-gas.

Very low levels (preferably zero) of organic chlorides can be tolerated in refineries. In cases of contamination of crude oil with organic chlorides, the typical method to handle such crude oil is to dilute the contaminated crude with crude containing no such contamination in order to provide a refinery stream with low enough levels of organic chloride to be tolerated by the refinery and comply with regulations. However, such a process is inefficient and challenging in terms of logistics and storage if contamination levels are substantially above the allowable limits.

U.S. Pat. No. 4,764,256 describes the removal of polychlorinated biphenyl compounds (PCB) from oil contaminated therewith, in a complex multistage extraction process.

CN106833719 describes a method of extraction and separation of crude oil, comprising a step of using a selective solvent extraction of crude oil, wherein the selective solvent includes a polar aprotic solvent.

It would be highly desirable to provide a simplified process for removing chemical contaminants, particularly organic chlorides, from crude oil. It would be even more preferable if such a process could be carried out without the addition of complicated apparatus and infrastructure.

SUMMARY OF THE INVENTION

The present invention provides a process for the removal of contaminants from contaminated crude oil in a vessel, said process comprising the steps of:

i) providing an organic solvent stream to the vessel containing said crude oil;

ii) mixing said crude oil and said organic solvent stream and then allowing an organic solvent bottom phase, comprising at least a portion of said organic solvent stream and at least a portion of said contaminants, to form;

iii) removing said organic solvent bottom phase from the vessel and retaining the remaining crude oil in the vessel;

iv) optionally, repeating steps i) to iii) one or more times with further organic solvent streams;

v) then providing an aqueous stream to the vessel;

vi) mixing said aqueous stream with the remaining crude oil in the vessel and allowing an aqueous bottom phase to form; and vii) removing the aqueous bottom phase from the vessel and retaining the remaining crude oil in the vessel; and viii) optionally, repeating steps v) to vii) one or more times with further aqueous streams.

DETAILED DESCRIPTION OF THE INVENTION

Figure 1:
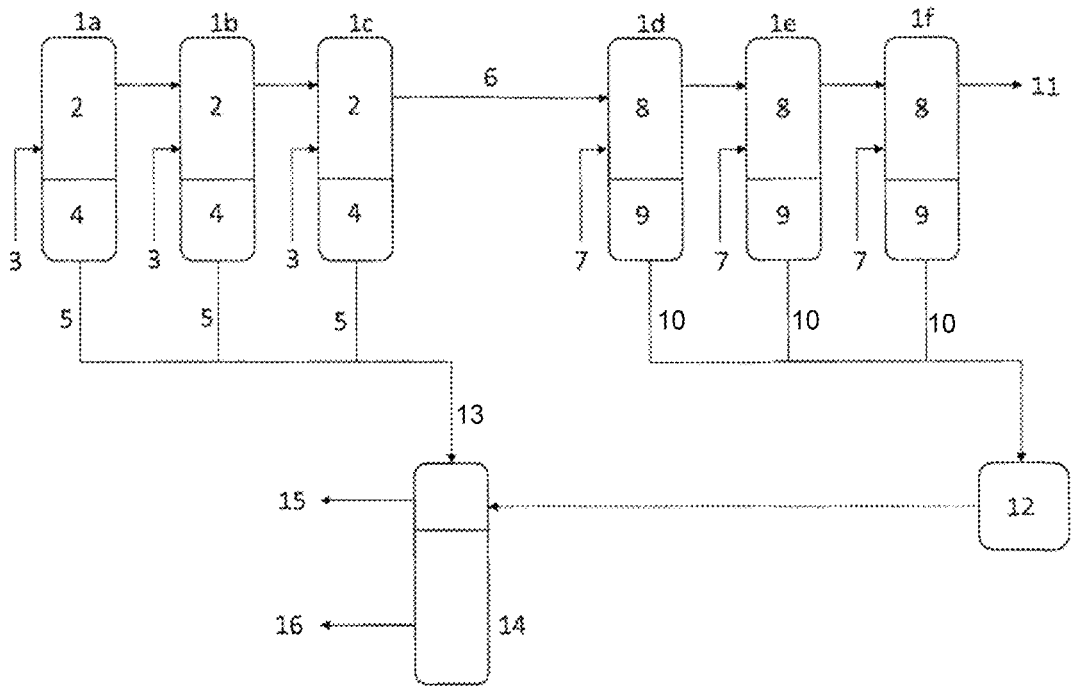
FIG. 1 shows a graphical representation of the process of the present invention.

While the process of the present invention and the stream(s) used in said process are described in terms of "comprising", "containing" or "including" one or more various described steps and components, respectively, they can also "consist essentially of" or "consist of" said one or more various described steps and components, respectively.

In the context of the present invention, in a case where a stream or a phase comprises two or more components, these components are to be selected in an overall amount not to exceed 100%.

Further, where upper and lower limits are quoted for a property then a range of values defined by a combination of any of the upper limits with any of the lower limits is also implied.

Surprisingly, it has been found that many contaminants can be removed from contaminated crude oil using a simple process comprising firstly, carrying out the steps of mixing the crude oil with an organic solvent stream, allowing two phases to separate and removing the lower, solvent-containing phase. These steps are preferably then repeated a number of times. Then, carrying out a similar process using an aqueous stream one or, preferably, more than one time.

The process of the present invention may be carried out in any vessel in which two liquid streams may effectively be mixed. Advantageously, the process may be carried out in crude oil storage tanks as long as they are fitted with some means of mixing the contents, providing a simple solution to handling contaminated crude oil supplies. Mixing may be carried out by any suitable method that allows thorough contacting between the solvent or aqueous stream and the crude oil. Said methods include, but are not limited to, allowing the organic solvent stream or aqueous stream to flow through the crude oil under gravity; mixing involving an agitation device such as a stirrer, a jet or a pump; and recirculating the tank contents through external piping. One method of mixing the solvent or aqueous stream and the crude oil is by pumping said solvent or aqueous stream into the vessel containing said crude oil using a pump with enough force to allow mixing of the solvent or aqueous stream and the crude oil. In a particularly preferred embodiment of the invention, mixing is carried out by recirculation, that is by removing a portion of the vessel contents at one point of the vessel and circulating it through external piping, preferably by using a pump, before returning it to the vessel at a different point.

The contaminants to be removed from the crude oil in the process of the present invention comprise polar components. Polar components comprise salts and/or heteroatom containing organic compounds. The salts may comprise organic and/or inorganic salts. The salts may comprise ammonium, an alkali metal, an alkaline earth metal or a transition metal as the cation and a carboxylate, sulphate, phosphate or a halide as the anion. The heteroatom containing organic compounds contain one or more heteroatoms, which may be oxygen, nitrogen, sulfur and/or a halogen. The heteroatom containing organic compounds may be aliphatic or aromatic.

The amount of said contaminants present in the contaminated crude oil before the process of the present invention may be greater than 0 wt % or at least 0.5 wt % or at least 1 wt % or at least 3 wt % or at least 5 wt % or at least 10 wt % or at least 15 wt % or at least 20 wt % and may be at most 30 wt % or at most 20 wt % or at most 10 wt % or at most 5 wt %.

The process of the present invention is particularly advantageous for the removal of organic halides, specifically organic chlorides, from crude oil. Therefore, it can be said that that preferably the contaminants to be removed from the crude oil are organic chlorides. Such organic chlorides include, but are not limited to, chloroform, carbon tetrachloride, tetrachloroethylene, vinyl chloride, chlorobenzene, Freon 113, chloroprene, propylene dichloride, dichloromethane and trichloroethylene. Such organic chlorides are not tolerated in refinery processes at very high levels. Therefore, they are considered as contaminants at very low levels.

The total amount of organic chloride contaminants present in the contaminated crude oil before the process of the present invention is greater than 0 ppmw or greater than 10 ppmw, or at least 20 ppmw, or at least 50 ppmw, or at least 100 ppmw, and may be at most 5000 ppmw, or at most 3000 ppmw, based on the overall weight of the crude oil.

The contaminated crude oil may be any crude oil which has not yet been subjected to refining. Preferably said crude oil is stabilized crude oil, i.e. crude oil that has been treated in a separator or collective stages of separators and stabilizers to remove gas and water.

In the process of the invention, an organic solvent stream is provided to the vessel containing said crude oil; the crude oil and the organic solvent stream are mixed and then mixing is stopped allowing a bottom phase comprising at least a portion of said organic solvent stream and at least a portion of said contaminants to form. This bottom phase is removed from the vessel leaving the remaining crude oil in the vessel. Preferably, these steps are then repeated one or more times.

The organic solvent stream may be provided directly to the vessel or may be provided indirectly, for example, in the embodiment wherein mixing is carried out by recirculation, by providing the organic solvent stream into the external piping through which a portion of the vessel contents are being circulated.

The weight ratio of the organic solvent stream to the crude oil in the vessel may be at least 0.05:1 or at least 0.2:1 or at least 0.5:1 or at least 1:1 or at least 2:1 or at least 3:1 and may be at most 5:1 or at most 3:1 or at most 2:1 or at most 1:1.

The temperature in the vessel may be at least 0° C. or at least 20° C. or at least 30° C. or at least 40° C. or at least 50° C. and may be at most 200° C. or at most 150° C. or at most 100° C. or at most 70° C. or at most 60° C. or at most 50° C. or at most 40° C.

The pressure in the vessel may be at least 100 mbara or at least 500 mbara or at least 1 bara or at least 1.5 bara or at least 2 bara and may be at most 20 bara or at most 15 bara or at most 10 bara or at most 5 bara or at most 3 bara or at most 2 bara or at most 1.5 bara.

The temperature and pressure in the vessel are preferably such that all of the contents of the vessel remain in the liquid state.

The organic solvent in the organic solvent stream as provided to the vessel in the present process, preferably has a density which is at least 1% or at least 5% or at least 8% or at least 10% or at least 15% or at least 20% and at most 200% or at most 100% or at most 50% or at most 40% or at most 35% or at most 30% higher than the density of the contaminated crude oil.

Further, it is preferred that the organic solvent in the organic solvent stream contains one or more heteroatoms, which may be oxygen, nitrogen and/or sulfur. Still further, it is preferred that said solvent is thermally stable at a temperature of 200° C. Still further, said solvent may have a boiling point which is at least 50° C. or at least 80° C. or at least 100° C. or at least 120° C. and at most 300° C. or at most 200° C. or at most 150° C.

In specific, the organic solvent in the organic solvent stream may be an aqueous solution of a quaternary ammonium salt, in specific trioctyl methyl ammonium chloride or methyl tributyl ammonium chloride or may be selected from one or more of the group consisting of diols and triols, including monoethylene glycol (MEG), monopropylene glycol (MPG) and any isomer of butanediol; glycol ethers, including oligoethylene glycols, including diethylene glycol and tetraethylene glycol, and ethers thereof, including diethylene glycol dimethylether; amides, including N-alkylpyrrolidone, wherein the alkyl group may contain 1 to 8 or 1 to 3 carbon atoms, including N-methylpyrrolidone (NMP), and dialkyl formamide, wherein the alkyl group may contain 1 to 8 or 1 to 3 carbon atoms, including dimethyl formamide (DMF); dialkylsulfoxide, wherein the alkyl group may contain 1 to 8 or 1 to 3 carbon atoms, including dimethylsulfoxide (DMSO); sulfolane; N-formyl morpholine (NFM); and furan ring containing components, including furfural, 2-methyl-furan and furfuryl alcohol. More preferably, the organic solvent in the organic solvent stream is above-mentioned N-alkylpyrrolidone, in specific NMP, or a furan ring containing component, in specific furfural. Most preferably, said solvent is NMP.

The organic solvent may also include a small amount of water, for example at least 0.5 wt % or at least 1 wt %.

Suitably the organic solvent contains no more than 10 wt %, preferably no more than 5 wt % of water. For example, the organic solvent may be NMP containing at least 0.5 wt % or at least 1 wt % and no more than 10 wt %, or no more than 5 wt % of water.

Further, the organic solvent in the organic solvent stream may have a Hansen solubility parameter distance $R_{a,heptane}$ with respect to heptane as determined at 25° C. of at least 10 $MPa/^{1/2}$, preferably at least 15 $MPa/^{1/2}$, and at most 30 $MPa/^{1/2}$, preferably at most 25 $MPa^{1/2}$. Still further, the organic solvent in the organic solvent stream may have a difference in Hansen solubility parameter distance $R_{a,heptane}$ with respect to heptane compared to Hansen solubility parameter distance $R_{a,toluene}$ with respect to toluene (i.e. $R_{a,heptane}-R_{a,toluene}$) as determined at 25° C. of at least 1.5 $MPa^{1/2}$, preferably at least 2 $MPa/^{1/2}$, and at most 4.5 $MPa/^{1/2}$, preferably at most 4 $MPa/^{1/2}$. In specific, it is preferred that the organic solvent in the organic solvent stream has an $R_{a,heptane}$ of at least 10 $MPa^{1/2}$ or at least 15 $MPa^{1/2}$ and a difference in $R_{a,heptane}$ compared to $R_{a,toluene}$ (i.e. $R_{a,heptane}-R_{a,toluene}$) of at most 4.5 $MPa^{1/2}$ or at most 4 $MPa^{1/2}$.

Hansen solubility parameters (HSP) can be used as a means for predicting the likeliness of one component compared to another component. More specifically, each component is characterized by three Hansen parameters, each generally expressed in $MPa^{0.5}$: $\delta_d$, denoting the energy from dispersion forces between molecules; $\delta_p$, denoting the energy from dipolar intermolecular forces between molecules; and $\delta_h$, denoting the energy from hydrogen bonds between molecules. The affinity between compounds can be described using a multidimensional vector that quantifies these solvent atomic and molecular interactions, as a Hansen solubility parameter (HSP) distance $R_a$ which is defined in Equation (1):

$$(R_a)^2=4(\delta_{d2}-\delta_{d1})^2+(\delta_{p2}-\delta_{p1})+(\delta_{h2}-\delta_{h1})^2 \quad (1)$$

Wherein:

$R_a$=distance in HSP space between compound 1 and compound 2 ($MPa^{0.5}$)

$\delta_{d1}$, $\delta_{p1}$, $\delta_{h1}$=Hansen (or equivalent) parameter for compound 1 (in $MPa^{0.5}$)

$\delta_{d2}$, $\delta_{p2}$, $\delta_{h2}$=Hansen (or equivalent) parameter for compound 2 (in $MPa^{0.5}$)

Thus, the smaller the value for $R_a$ for a given solvent calculated with respect to the compound to be recovered (i.e., the compound to be recovered being compound 1 and the solvent being compound 2, or vice versa), the higher the affinity of this solvent for the compound to be recovered will be.

Hansen solubility parameters for numerous solvents can be found in, among others, *CRC Handbook of Solubility Parameters and Other Cohesion Parameters, Second Edition* by Allan F. M. Barton, CRC press 1991; *Hansen Solubility Parameters: A User's Handbook* by Charles M. Hansen, CRC press 2007.

Preferably steps i) to iii) of the process of the invention are repeated in turn one or more times. That is, in each repeat an organic solvent stream is provided to the vessel containing said crude oil; the crude oil and organic solvent stream are mixed, the mixing is stopped, allowing a bottom phase comprising at least a portion of said organic solvent stream and at least a portion of said contaminants to form. This bottom phase is removed from the vessel and the remaining crude oil is retained in the vessel per each cycle of repeats.

More preferably, steps i) to iii) of the process are repeated 2 or more times, i.e. steps i) to iii) are carried out 3 times or more in total. Even more preferably, steps i) to iii) of the process are repeated 3 or more times, i.e. steps i) to iii) are carried out 4 times or more in total.

In each repeat of step i) a fresh organic solvent stream is used. It is preferable that the same type of solvent is used in each repeat of steps i) to iii).

When the contaminants to be removed from the contaminated crude oil comprise organic chlorides, it is preferred that, after steps i) to iii) have been carried out a suitable number of times, the total amount of organic chloride contaminant in the remaining crude oil in the vessel is less than 10 ppmw, preferably no more than 5 ppmw, more preferably 1 ppmw on the basis of the overall weight of the crude oil in the vessel.

At this stage, an amount of the organic solvent will be retained in the remaining crude oil. Typically, the content of the organic solvent in the remaining crude oil will be no more than 20 wt % or no more than 10 wt % or no more than 8 wt %, based on the overall weight of the remaining crude oil.

An aqueous stream is then provided to the vessel in step v). The remaining crude oil and the aqueous stream are mixed and then mixing is stopped allowing a bottom phase comprising at least a portion of said aqueous stream to form. This bottom phase is removed from the vessel leaving the remaining crude oil in the vessel.

Preferably, steps v) to vii) of the process of the invention are repeated in turn one or more times. That is, in each repeat, an aqueous stream is provided to the vessel containing said crude oil; the crude oil and aqueous stream are mixed, the mixing is stopped, allowing an aqueous bottom phase to form. This aqueous bottom phase is removed from the vessel and the remaining crude oil is retained in the vessel per each cycle of repeats.

More preferably, steps v) to vi) of the process are repeated 2 or more times, i.e. steps v) to vii) are carried out 3 times or more in total. Even more preferably, steps v) to vii) of the process are repeated 3 or more times, i.e. steps v) to vii) are carried out 4 times or more in total.

The weight ratio of the aqueous stream to the crude oil in the vessel may be at least 0.05:1 or at least 0.2:1 or at least 0.5:1 or at least 1:1 or at least 2:1 or at least 3:1 and may be at most 5:1 or at most 3:1 or at most 2:1 or at most 1:1.

Preferably, after steps v) to viii) of the process have been carried out a suitable number of times, there is less than 0.3 wt % or no more than 0.2 wt % or no more than 0.1 wt % or no more than 0.01 wt % based on the overall weight of the crude oil in the vessel of solvent retained in the crude oil.

The crude oil may then be processed in standard refinery processes.

In a further advantageous embodiment of the invention, at least a portion of the organic solvent bottom phase from step iii) is contacted with at least a portion of the aqueous bottom phase from step vii).

In this embodiment, advantageously the water in the aqueous bottom phase acts as anti-solvent for the contaminants dissolved in the organic solvent bottom phase.

After mixing, a lighter organic phase will separate from a recycle bottom phase comprising the remaining aqueous bottom phase and the organic solvent bottom phase.

Said lighter organic phase may be removed by decanting. The addition of successive portions of the aqueous bottom phase, followed by decanting of each lighter organic phase allows the separation of different fractions of the organic components extracted from the crude oil by the organic solvent. Those fractions with low levels of organic chlorides may be blended back to the crude in order to maintain the original crude oil properties, such as viscosity, as much as possible.

In this embodiment, the final recycle bottom phase can be separated by distillation at atmospheric pressure or sub-atmospheric pressure in order to prepare an organic solvent recycle stream and an aqueous recycle stream. Theses streams may then be re-used in the process of the present invention as an organic solvent stream and an aqueous stream, respectively. AS up to 10 wt % of water may be present in the organic solvent stream, this separation need not be perfect.

DETAILED DESCRIPTION OF THE DRAWINGS

The process of the present invention is illustrated schematically in FIG. 1.

In FIG. 1, each of the vessels as drawn (1*a*, 1*b*, 1*c*, 1*d*, 1*e*, 1*f*) represent the same vessel in which all of steps i) to viii) are carried out.

In the first set of steps i) to iii), an organic solvent stream (3) is added to the vessel (1*a*) containing the contaminated crude oil and mixed with the crude oil present in said vessel (1*a*). After a period of time the mixing is stopped and an upper phase comprising crude oil (2) and a bottom phase (4) comprising at least a portion of said organic solvent stream and at least a portion of the contaminants are allowed to form. The bottom phase (4) is removed from the vessel (1*a*) through a pipe (5).

These steps are then repeated in the same vessel (1*b*, 1*c*) one or more times. In this exemplary embodiment, the three steps are carried out a total of 3 times, but this is not intended to be limiting.

The remaining crude oil (6) in the same vessel (1*d*) is mixed with an aqueous stream (7). After a period of time the mixing is stopped and an upper phase comprising crude oil (8) and an aqueous bottom phase (9) are allowed to form. The aqueous bottom phase (9) is removed from the vessel (1*d*) through a pipe (10).

At least a portion of the combined (13) organic solvent bottom phases (4) are then combined and mixed with a portion of the combined (12) aqueous bottom phases (9) in a separate vessel (14).

The water in the aqueous bottom phase acts as anti-solvent for the contaminants dissolved in the organic solvent bottom phase. After mixing, a lighter organic phase (15) will separate from a recycle bottom phase (16) comprising the remaining aqueous bottom phase and the organic solvent bottom phase.

Said lighter organic phase may be removed by decanting.

Once this stage of the process has been repeated a number of times, the final recycle bottom phase (16) can be separated and sent to a distillation column operating at atmospheric pressure or sub-atmospheric pressure in order to prepare an organic solvent recycle stream and an aqueous recycle stream.

Figure 2:
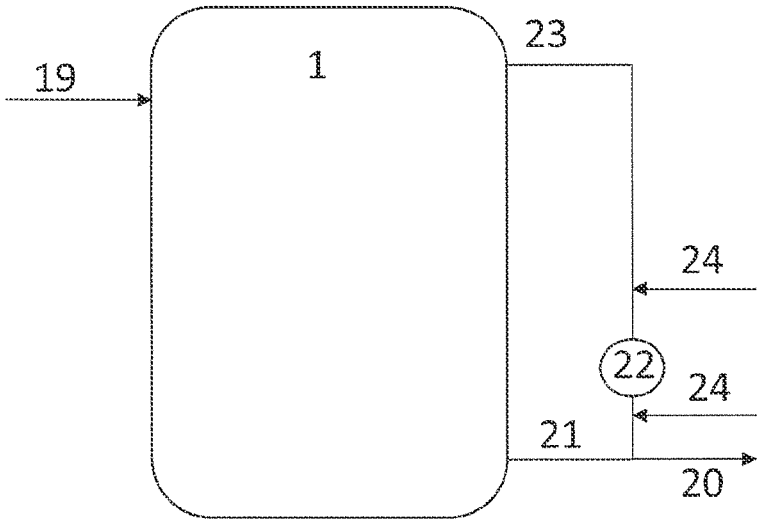
FIG. 2 shows an exemplary, but not limiting, embodiment of a vessel (1) to be used in the process of the present invention.

FIG. 2 shows an exemplary, but not limiting, embodiment of a vessel (1) to be used in the process of the present invention.

The vessel (1) is fitted with at least one inlet (19) and at least one outlet (20) allowing the ingress and egress of fluids into the vessel (1). The vessel (1) is also fitted with a re-circulation system including an outlet from the vessel (21) a pump (22) and an inlet into the vessel (23) to allow mixing of the contents of the vessel. An inlet into the recirculation system (24) may be provided either before or after the pump (22) to allow addition of the organic solvent and/or aqueous streams.

The present invention is further described below by reference to the following examples, which are not intended to limit the scope of the present invention in any way.

EXAMPLES

Example 1

A sample volume of Urals crude oil was contacted with equal volumes of an organic solvent stream comprising dry NMP solvent in 4 consecutive stages at ambient temperature and ambient pressure in a glass funnel with bottom draining valve.

In each stage, the organic solvent stream was added to the crude oil, mixed thoroughly and left to settle, forming an organic solvent bottom phase, which was then drained off, leaving the remaining crude oil in the vessel. The remaining crude oil from each stage was sampled for analysis. Organic chloride concentrations in the original crude oil sample and the remaining crude oil after the $1^{st}$ and $4^{th}$ stage were analysed and are reported in Table 1 below.

It has been clearly shown that contaminants comprising organic chlorides are effectively removed from crude oil using a series of solvent washes.

TABLE 1

| Sample | Crude oil | Remaining crude oil after $1^{st}$ stage | Remaining crude oil after $4^{th}$ stage |
|---|---|---|---|
| Dichloromethane (ppmw) | <0.1 | <0.1 | <0.1 |
| Trichloromethane (ppmw) | 2.1 | 0.2 | <0.1 |
| Tetrachloromethane (ppmw) | 26.8 | 7.5 | <0.1 |
| Trichloroethylene (ppmw) | 0.6 | 0.1 | <0.1 |
| Tetrachloroethylene (ppmw) | 0.5 | 0.4 | <0.1 |
| Total organic chloride (ppmw) | 30 | 8.2 | <0.1 |

Example 2

A sample volume of Urals crude oil in a glass vessel was contacted with half its volume of an organic solvent stream comprising dry NMP solvent. The mixture was left to settle, forming an organic solvent bottom phase, which was then drained off, leaving the remaining crude oil in the vessel. Subsequently, the remaining crude oil volume was contacted with half its volume of an aqueous stream. The mixture was then left to settle, forming an aqueous bottom phase.

In this example both dry NMP solvent and aqueous solvent were introduced into the glass vessel by dripping droplets through a plate with holes at ambient temperature and ambient pressure.

Samples were taken from a sampling point in the glass vessel during contacting and after phases have settled. The samples were analysed for concentration of organic chlorides and NMP and the results are reported in Table 2 below.

TABLE 2

| Sample | Crude oil before process | Remaining crude oil after NMP solvent contact | Remaining crude oil after aqueous solvent contact |
|---|---|---|---|
| NMP (ppmw) | Below detection | ~35000 | 1785 |
| Trichloromethane (ppmw) | 13 | 3 | 8 |
| Tetrachloromethane (ppmw) | 118 | 81 | 93 |

These results clearly demonstrate both the removal of organic chlorides from crude oil using a solvent (NMP) wash and the removal of residual solvent (NMP) from the remaining crude oil using an aqueous wash.

We claim:

1. A process for the removal of contaminants from contaminated crude oil in a vessel, said process comprising the steps of:

i) providing an organic solvent stream to the vessel containing crude oil contaminated with an organic chloride;

ii) mixing said crude oil and said organic solvent stream and then allowing an organic solvent bottom phase, comprising at least a portion of said organic solvent stream and at least a portion of said organic chloride to form;

iii) removing said organic solvent bottom phase from the vessel and retaining the remaining crude oil in the vessel;

iv) optionally, repeating steps i) to iii) one or more times with further organic solvent streams;

v) then providing an aqueous stream to the vessel;

vi) mixing said aqueous stream with the remaining crude oil in the vessel and allowing an aqueous bottom phase to form; and vii) removing the aqueous bottom phase from the vessel and retaining the remaining crude oil in the vessel; and viii) optionally, repeating steps v) to vii) one or more times with further aqueous streams.

2. A process according to claim 1, wherein the organic chloride is selected from the group consisting of chloroform, carbon tetrachloride, tetrachloroethylene, vinyl chloride, chlorobenzene, Freon 113, chloroprene, propylene dichloride, dichloromethane, trichloroethylene, and combinations thereof.

3. A process according to claim 2, wherein the amount of organic chloride in the contaminated crude oil is greater than 10 ppmw based on the overall weight of the contaminated crude oil.

4. A process according to claim 1, wherein the contaminated crude oil is a stabilised crude oil.

5. A process according to claim 1, wherein one or both of the mixing steps is carried out by removing a portion of the contents of the vessel at one point of the vessel; circulating said portion via external piping; and returning it to the vessel at a different point.

6. A process according to claim 5, wherein the organic solvent stream and/or the aqueous stream are provided to the vessel by being added at a point in the external piping.

7. A process according to claim 1, wherein the organic solvent stream comprises NMP.

8. A process according to claim 1, wherein the organic solvent stream comprises NMP and at least 0.5 wt % and no more than 10 wt % of water, based on the overall weight of the organic solvent stream.

9. A process according to claim 1, wherein, after steps i) to iii) and optional step iv), the organic chloride in the remaining crude oil is no more than 10 ppmw, based on the overall weight of the remaining crude oil.

10. A process according to claim 1, wherein at least a portion of the organic solvent bottom phase from step iii) is contacted with at least a portion of the aqueous bottom phase from step vii); said two portions are mixed and allowed to settle to form a lighter organics phase which is removed by decanting and a recycle bottom phase.

11. A process according to claim 1, wherein, after steps i) to iii) and optional step iv), the organic chloride in the remaining crude oil is no more than 5 ppmw based on the overall weight of the remaining crude oil.

* * * * *